United States Patent [19]

Rodgers et al.

[11] 4,379,683

[45] Apr. 12, 1983

[54] CONCRETE FORMING APPARATUS

[76] Inventors: Stuart N. Rodgers; Sidney J. Voycheshin, both of 7605 - 115 St., Delta, British Columbia, Canada, V4C 5M9

[21] Appl. No.: 149,726

[22] Filed: May 14, 1980

[51] Int. Cl.[3] ..... E01C 19/38

[52] U.S. Cl. ..... 425/62; 404/96; 404/98; 404/102; 404/119; 425/456

[58] Field of Search ..... 425/62, 456; 249/2; 404/96, 98, 102, 106, 118, 119

[56] References Cited

U.S. PATENT DOCUMENTS

| | | | |
|---|---|---|---|
| 2,902,910 | 9/1959 | Malsbury et al. | 425/62 |
| 2,962,785 | 12/1960 | Young | 425/456 |
| 2,962,949 | 12/1960 | O'Dea | 404/119 |
| 3,110,234 | 11/1963 | Oster | 404/119 |
| 3,363,524 | 1/1968 | Catenacci | 425/62 |
| 3,423,492 | 1/1969 | Jonell et al. | 425/456 |
| 3,915,583 | 10/1975 | Aparicio | 404/98 |
| 4,280,800 | 7/1981 | Bunn | 425/62 |

FOREIGN PATENT DOCUMENTS

| | | | |
|---|---|---|---|
| 666674 | 7/1963 | Canada | 404/118 |
| 673645 | 6/1952 | United Kingdom | 404/119 |
| 823701 | 11/1959 | United Kingdom | 404/118 |

*Primary Examiner*—James B. Lowe

*Attorney, Agent, or Firm*—Fulwider, Patton, Rieber, Lee & Utecht

[57] ABSTRACT

Apparatus for forming, compacting and finishing the top surface of concrete poured between a pair of removable longitudinally extending parallel opposed forms. The apparatus, which is self-propelled, travels along the tops of the forms. A heavy wooden vibrator member disposed at the forward end of the apparatus may be shaped so that concrete beneath the vibrator is formed and compacted to a depth which varies along transverse axes of the forms. The structural members of the apparatus may be interchanged or adjusted to adapt the apparatus for use with forms of arbitrary spacing. Simple adjustments may also be made to permit the apparatus to traverse forms of unequal height. Removable "skirts" enable use of the apparatus with relatively narrow forms supported above the grade on which the concrete segment is formed—the skirts serve as a "travelling form" to prevent poured concrete formed and compacted by the vibrator spilling beneath the forms.

14 Claims, 8 Drawing Figures

CONCRETE FORMING APPARATUS

BACKGROUND OF THE INVENTION

1. Field of the Invention

This invention relates to apparatus for forming concrete and, in particular, to self-propelled apparatus that is capable in a single pass of forming, compacting, and finishing the top surface of concrete poured between a pair of removable longitudinally extending parallel opposed forms.

2. Description of the Prior Art

Concrete finishing machines of various types are known per se, but these have tended to be relatively complex (including, for example, hoppers for receiving concrete and spreading mechanisms for distributing the concrete) or have suffered from other disadvantages such as the need to make several "passes" over the concrete surface in order to produce the desired smooth finish. Prior art concrete finishing machines appear to have been directed primarily to the formation of a flat uniform surface between a pair of longitudinally extending parallel opposed forms.

SUMMARY OF THE INVENTION

The present invention, by contrast, facilitates in a single pass the formation, compaction and finishing of the top surface of a segment of poured concrete, the depth of which may vary along transverse axes of a pair of removable longitudinally extending parallel opposed forms. For example, the apparatus may be used to construct a continuous (or "monolithic") section of sidewalk together with the related curb and gutter in a single pass. Alternatively, the apparatus may be used to form a monolithic section of road bed together with associated gutter(s). The apparatus may be adjusted to facilitate construction of road beds or sidewalks of varying widths.

In accordance with the present invention there is provided apparatus for forming, compacting and finishing the top surface of concrete poured between a pair of removable longitudinally extending parallel opposed forms. The apparatus comprises a frame having forward and rearward ends which extend transversely between opposed first and second sides of the frame, the ends and the sides substantially defining a plane. A wooden concrete pre-finishing member is disposed along the forward end of the frame. The pre-finishing member is relatively wide when measured in the direction of longitudinal extension of the forms. Vibrator means for causing vibration of the pre-finishing member are affixed to the frame. A finishing pan is rigidly affixed beneath the frame to the rear of and adjacent the pre-finishing member and extends between the first and second sides of the frame. Transporting means are provided on the first and second sides of the frame for engaging the frame on top of the forms and for permitting movement of the apparatus along the forms with the ends extending transversely of the forms and with the pre-finishing member extending transversely between the forms. Propulsion means are affixed to the frame for propelling the apparatus along the tops of the forms.

In a preferred embodiment, the vertical distance between the plane of the frame and the lower surface of the pre-finishing member and the finishing pan varies along transverse axes of the forms whereby poured concrete beneath the apparatus is formed, compacted and finished to a depth which varies along transverse axes of the forms. A portion of the lower surface of the pre-finishing member is shaped to define a semi-conical recess in the member in regions of relatively abrupt change in the vertical distance, the apex of the semi-conical recess lying at the rearward edge of the lower surface of the member and the base of the semi-conical recess lying along the forward edge of the lower surface of the member.

Advantageously, the transporting means comprises first and second roller pairs. Preferably, extension means are provided for adjustably fixing one of the roller pairs on one side of the apparatus at selected distances from the plane of the frame. The extension means may comprise a pair of cylindrically apertured sleeves rigidly affixed at opposed ends of one side of the frame and perpendicular to the plane of the frame, a pair of tubes each of the tubes being slidingly receivable by one of the pair of sleeves and each of the tubes including means for coupling one of the rollers to one of the tubes and means for affixing the tubes at selected positions within the sleeves.

Advantageously, for enabling use of the apparatus with relatively narrow forms, a pair of skirts are provided to extend along either side of the frame and project ahead of the forward end of the frame between the lower surface of the forms and the grade on which the concrete segment is formed, whereby poured concrete beneath the member is retained between the skirts.

DESCRIPTION OF THE PREFERRED EMBODIMENT

Figure 1:
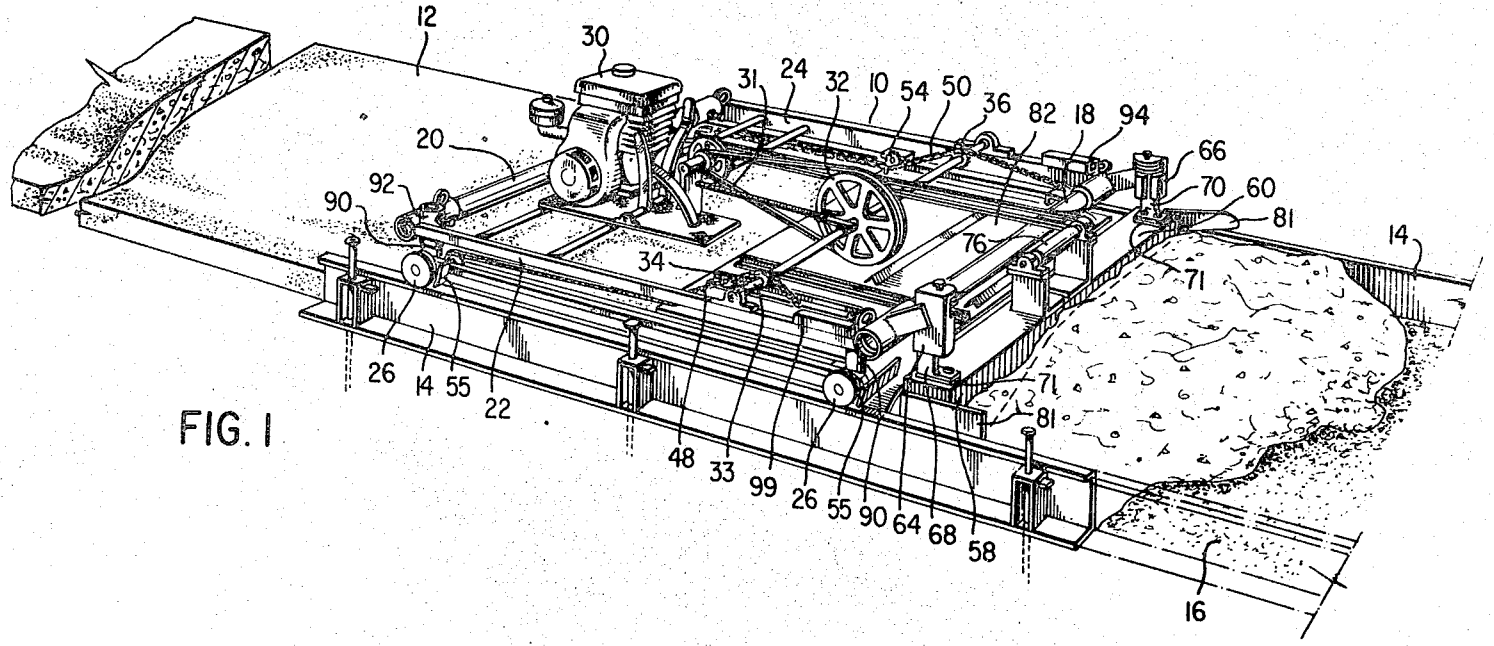
FIG. 1 depicts in perspective an embodiment of the apparatus in operation forming, compacting and finishing the top surface of a segment of poured concrete to form a monolithic sidewalk together with associated curb and gutter.

FIG. 1 depicts an apparatus, generally designated 10, for forming, compacting and finishing the top surface of a segment of poured concrete 12 between a pair of longitudinally extending parallel opposed forms 14. Forms 14 are removably affixed at a predetermined spacing from each other atop the grade 16 over which concrete segment 12 is to be formed. In some cases, reinforcing material such as steel mesh (not shown) may be disposed between forms 14 to be covered by the concrete, thereby strengthening the finished segment.

Apparatus 10 comprises a frame having a forward end generally designated 18, a rearward end generally designated 20, and first and second sides generally designated 22 and 24 respectively; the ends and the sides substantially defining a plane. Roller pairs 26 and 28 are provided respectively on frame sides 22 and 24. The roller pairs constitute transporting means for engaging the apparatus atop forms 14 and for permitting movement of the apparatus along the forms with frame ends 18 and 20 extending transversely of the forms. Frame ends 18 and 20 may conveniently comprise sections of tubing which may be interchanged or, alternatively, telescopically extended or compressed to adjust the spacing between the pairs of roller means to equal the transverse spacing between forms 14. The apparatus may thus be adapted for construction of concrete segments of widths ranging from relatively narrow curb sections, to medium-width sidewalks, to relatively wide road beds.

Figure 2:
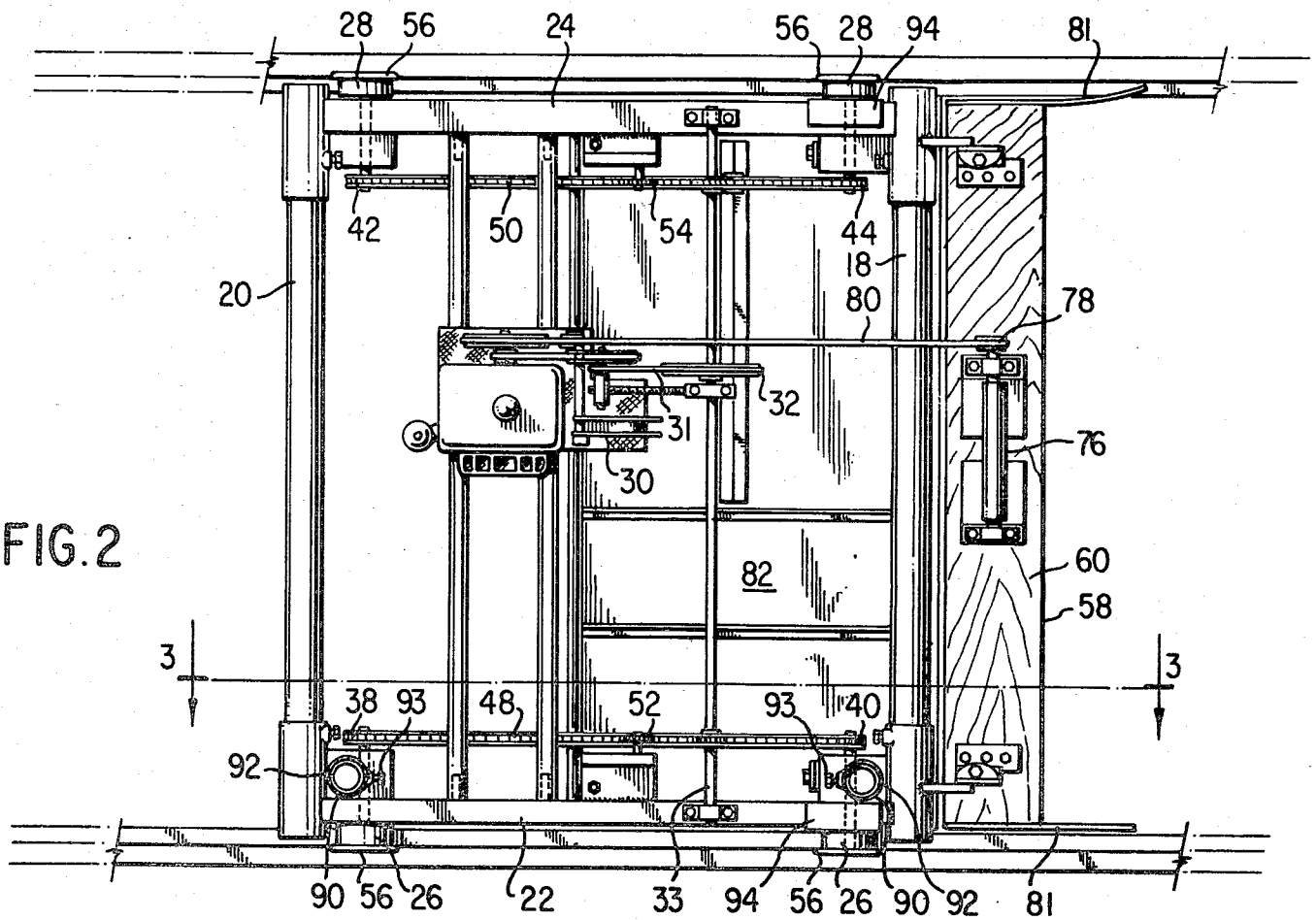
FIG. 2 is a plan view of the apparatus of FIG. 1.

Roller pairs 26 and 28 are rotationally driven by engine 30 to propel the apparatus along the tops of the forms. A belt 31 and pulley 32 are provided for driving engagement of engine 30 with shaft 33 which extends generally parallel to frame ends 18 and 20. (As with all other components of the apparatus which extend the width of the apparatus, shaft 33 may be made interchangeable or, alternatively, may be made telescopically adjustable to permit expansion or contraction thereof in adaptation of the width of the apparatus for use with forms of differing transverse spacings). Drive gears 34 and 36 are rigidly affixed at opposed ends of shaft 33 for rotation therewith. Gears 38 and 40 in one case, and 42 and 44 in the other (best seen in FIG. 2) are rigidly affixed to roller pairs 26 and 28 respectively. Chains 48 and 50 couple drive gears 34 and 36 to gear pairs 38, 40 and 42, 44 respectively. Idler gears 52 and 54 are positioned to maintain the tension of chains 48 and 50 with respect to drive gears 34 and 36 respectively. It will thus be understood that engine 30 may be actuated to rotate shaft 33 and, with it, drive gears 34 and 36 to rotationally drive roller pairs 26 and 28, thereby propelling apparatus 10 along the tops of forms 14. Scrapers 55 are affixed to the frame to drag along the tops of forms 14 ahead of the rollers and remove loose foreign material which might interfere with rotation of the rollers.

The rollers are provided with outer flanges 56 (FIG. 2) which project below the uppermost outer edges of forms 14 to prevent slippage of apparatus 10 transversely with respect to forms 14. Similar additional flanges (not shown) may be provided on the inside edges of either one of a pair of diagonally opposed rollers to improve traction when the apparatus negotiates bends in the forms. The inventors have found it preferable not to provide such double flanges on pairs of transversely opposed rollers because the transverse spacing between forms 14 may vary somewhat. If the spacing between forms 14 became marginally greater than the spacing between a pair of transversely opposed double flanges, the rollers would tend to "bind" against forms 14 inhibiting propulsion of apparatus 10 along the tops of forms 14.

Figure 3:
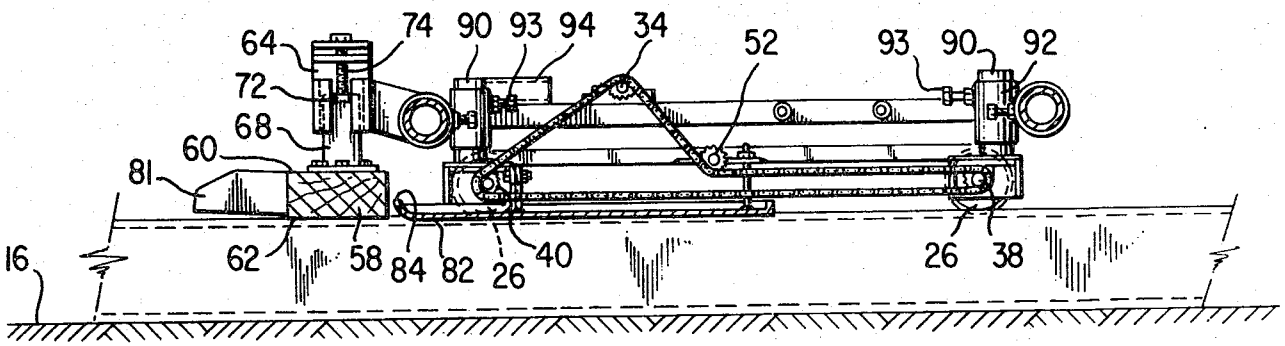
FIG. 3 is a cross-sectional view with reference to line 3—3 of FIG. 2.

A concrete pre-finishing member, or "vibrator screed" 58 having an upper surface 60 and a relatively smooth lower surface 62 is disposed along frame forward end 18 to extend transversely between forms 14. It is important to note that, in operation, screed 58 does not touch forms 14—the width of screed 58 should be slightly less than the transverse spacing between forms 14. Channel brackets 64 and 66 are welded at opposed sides of frame forward end 18. Angle brackets 68 and 70 affixed to screed upper surface 60 are slidingly received by channel brackets 64 and 66 respectively. Soft rubber spacers 71 are positioned between angle brackets 68, 70 and screed upper surface 60 to absorb vibrations of screed 58 which would otherwise be transmitted to apparatus 10 and thence to forms 14. As shown in FIG. 3, a threaded sleeve 72 is welded to each of angle brackets 68 and 70 to receive threaded guide pin 74. Vibrator screed 58 is thus mounted at frame forward end 18 to permit concrete-tamping vibration of vibrator screed 58. The height of vibrator screed 58 may be varied by advancing or retracting guide pins 74 with respect to sleeves 72.

A weighted eccentric lobe 76 is affixed to screed upper surface 60 for rotation about an axis substantially parallel to frame forward end 18. Pulley 78 and belt 80 are provided for rotational driving of eccentric lobe 76 by engine 30. In operation, engine 30 causes eccentric lobe 76 to rotate which in turn causes concrete-tamping vibration of vibrator screed 58.

The inventors have found that it is important that vibrator screed 58 be made of wood (some materials such as metal leave a rough, uneven surface on concrete segment 12). It has been determined that vibrator screed 58 should be made relatively wide (typically about 8 inches) in the direction parallel to the direction of longitudinal extension of forms 14 to prevent excess concrete bubbling under vibrator screed 58 to leave a rough surface which would require manual finishing. It is also desirable to make vibrator screed 58 at least several inches high so that it may push excess poured concrete ahead of the apparatus and ensure an ample supply of concrete to fill any voids beneath screed lower surface 62. For example, if the apparatus is to be used to construct a concrete segment such as a sidewalk having a width of about 5 feet and a depth of about 4 inches, then vibrator screed 58 should measure approximately 4 feet 11 inches across frame forward end 18 by about 8 inches wide by about 4 inches high. Deflector fins 81 are affixed to opposed sides of vibrator screed 58 to prevent loose concrete spilling over the tops of forms 14.

Finishing pan 82, which may be a metal sheet having a flat surface, is affixed underneath the frame to extend widthwise thereof and to "glide" behind vibrator screed 58 atop the concrete surface to impart a final smoothing finish thereto. Advantageously, an upturned lip 84 is provided at the forward end of finishing pan 82 to provide a smooth transition between the concrete surface and the finishing pan. In addition, a gap of about one to two inches should be provided between the trailing edge of vibrator screed 58 and the leading edge of finishing pan 82 to prevent binding of rocks or other particulate material between the vibrator screed and the finishing pan. Finishing pan 82 extends only about one-half the length of apparatus 10. The inventors have found that it is desirable not to make finishing pan 82 substantially longer than this or the apparatus may tend to "float" on concrete segment 12 causing the rollers to lift free of forms 14.

Figure 4:
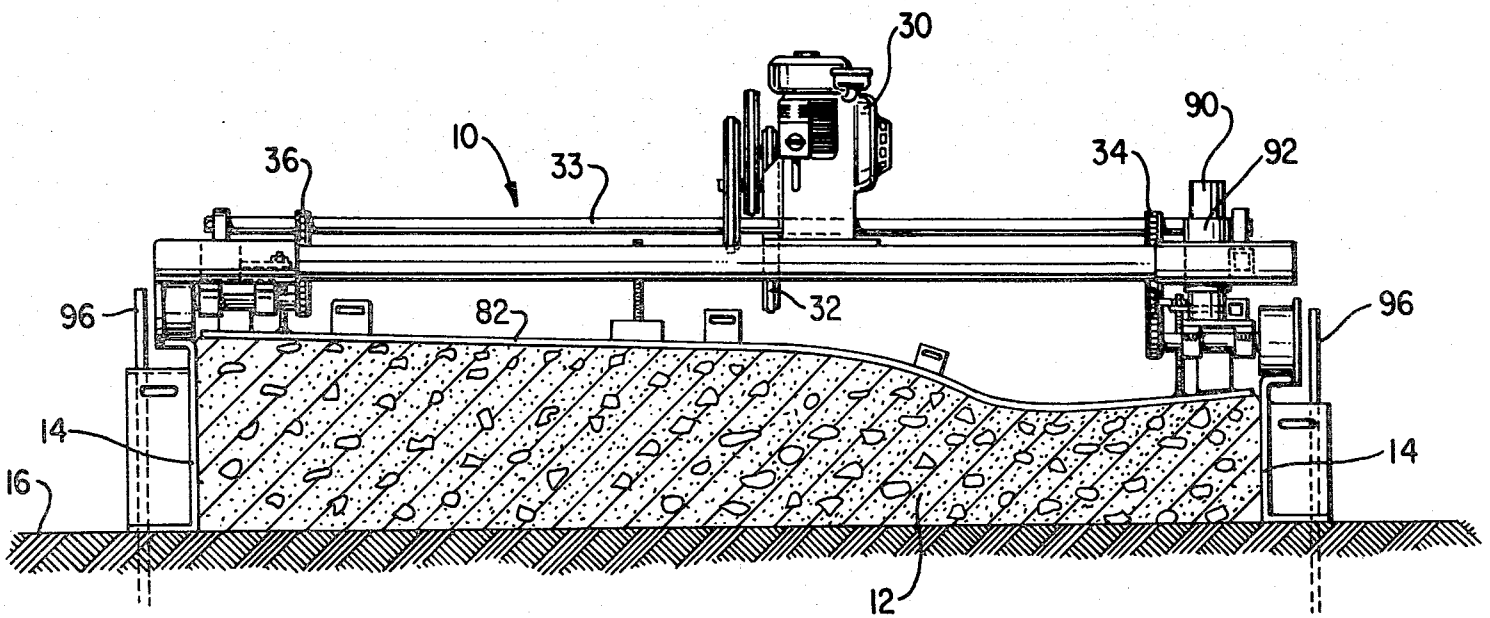
FIG. 4 is a rear elevation view of the apparatus of FIG. 1.

An extremely important feature of the invention is the ability to form, compact and finish in a single pass the top surface of a segment of concrete the depth of which may vary along transverse axes of forms 14. This feature has application, for example, in the construction of a "monolithic" sidewalk wherein a sidewalk together with associated curb and gutter is formed, compacted and finished by the apparatus in a single pass. To achieve this result, vibrator screed 58 and finishing pan 82 are contoured to conform their cross-sectional shape to the desired shape of the finished concrete segment. (Of course, if it is desired to produce a concrete segment having a flat finished surface substantially level with the tops of forms 14 then screed lower surface 62 and finishing pan 82 are simply made flat). FIG. 5 depicts in three separate views a vibrator screed suitable for construction of a monolithic sidewalk together with associated curb and gutter. In FIG. 5, the pedestrian-travelled portion of the sidewalk is formed beneath the right hand side flat section of screed lower surface 62. The sidewalk curb is formed beneath contoured section 86 of vibrator screed 58 and the gutter is formed beneath the left hand side flat section 88 of screed lower surface 62. As shown in FIG. 4, finishing pan 82 is also contoured such that its lower surface, when viewed in cross-section, is similar to the cross-sectional shape of screed lower surface 62. (FIG. 4 depicts a finishing pan suitable for use with the vibrator screed of FIG. 5 to construct a monolithic sidewalk. Other shapes of screed 58 and finishing pan 82 may be interchanged in combination to construct concrete segments of different cross-sectional shapes).

Figure 5A:
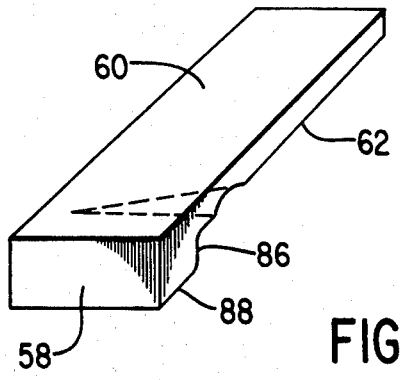
FIG. 5A depicts a vibrator screed suitable for construction of a monolithic sidewalk with associated curb and gutter.
Figure 5B:
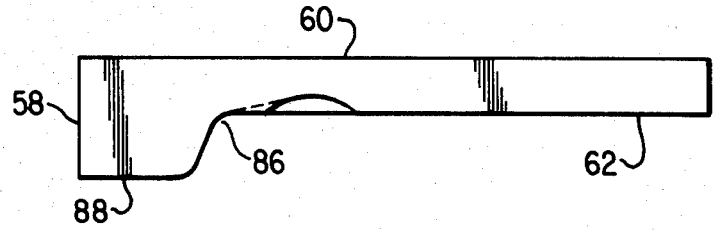
FIG. 5B is a cross-sectional view of the vibrator screed of FIG. 5A.
Figure 5C:
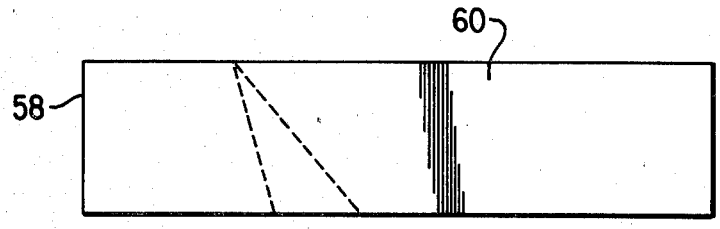
FIG. 5C is a top view of the vibrator screed of FIG. 5A.

The inventors have found it necessary to provide a means for "packing" concrete above regions of relatively abrupt change in depth of a concrete segment. For example, a relatively abrupt change in the depth of concrete segment 12 shown in FIG. 4 occurs at the curb, which constitutes a region of transition from the relatively deep concrete bed beneath the pedestrian-travelled portion of the sidewalk to the relatively shallow concrete bed beneath the associated gutter. The inventors have found that if provision is not made for "packing" concrete above the curb section of concrete segment 2 then the curb may be left with a "ragged" edge replete with voids or pockets which arise because concrete is not uniformally distributed in the curb region. To alleviate this problem, screed lower surface 62 is shaped as depicted in FIGS. 5A through 5C to provide a semi-conical recess in regions of abrupt change in the vertical distance between screed lower surface 62 and the plane defined by the ends and sides of the frame (which regions correspond directly to regions of abrupt change in depth of the concrete segment). The "apex" of the semi-conical recess lies at the rearward edge of screed lower surface 62 and its base (or "mouth") lies along the forward edge of screed lower surface 62. The "mouth" is offset to one side of the region of abrupt change. The recess tapers from the "mouth" back to the "apex" which lies above the region of abrupt change. The semi-conical recess constitutes a sort of "funnel" which guides a relatively large volume of concrete to be formed and compacted in the region of abrupt change in vertical depth of the concrete bed.

Another important feature of the apparatus which futher enhances its ability to construct concrete segments having a depth which varies along transverse axes of forms 14 is the provision for independently raising or lowering the rollers on one side of the frame with respect to the rollers on the other side of the frame. This is important because, as shown in FIG. 4, forms used to construct a monolithic sidewalk together with associated curb and gutter are typically higher on the pedestrian-travelled side of the sidewalk than on the gutter side of the sidewalk since the concrete segment is relatively shallow beneath the gutter as compared with its depth beneath the pedestrian-travelled portion of the sidewalk. If apparatus 10 is to traverse forms of unequal height, provision must be made to maintain the apparatus substantially level with respect to grade 16 so that the surface of the finished sidewalk or road bed will be level. To achieve this purpose legs 90 (which may be tubes) are slidingly received in cylindrically apertured sleeves 92 which are rigidly affixed at opposed ends of one side of the frame and perpendicular to the plane of the frame (best seen in FIGS. 3 and 4). The lower ends of each of legs 90 are affixed to axles for coupling to the rollers 26. A series of co-operating vertically spaced threaded apertures are provided in legs 90 and sleeves 92 for receiving threaded pins 93 which fix the legs in position relative to the sleeves. The rollers on one side of the frame may thus be positioned at a desired vertical offset with respect to the rollers on the opposite side of the frame, thereby permitting apparatus 10 to remain level with respect to grade 16 while travelling along the tops of forms of unequal height.

Forms 14 are removably affixed to grade 16 by means of pins 96 which are driven through apertures provided in flanges on the sides of forms 14 and into the ground. The opposed inward-facing sides of forms 14 define a channel between which concrete segment 12 is formed. The inward facing sides of forms 14 extend vertically upward from the grade to at least the desired height which the finished segment is to extend above the grade.

Typically, forms 14 are metal and are relatively heavy which makes them somewhat difficult to position and relatively costly to transport between job sites. A feature of the apparatus depicted in FIG. 6 permits its use with relatively narrow forms without inhibiting the depth of the concrete segment which may be formed with the apparatus. For example, 12" high forms which might conventionally be used to form a 12" deep concrete segment may be replaced as hereinafter described with relatively narrow forms having a height of, say, 3 inches which may still be used to form a 12" deep concrete segment. Thus the cost of the forms themselves may be reduced and their handling and transportation may be made somewhat easier and less costly.

Figure 6:
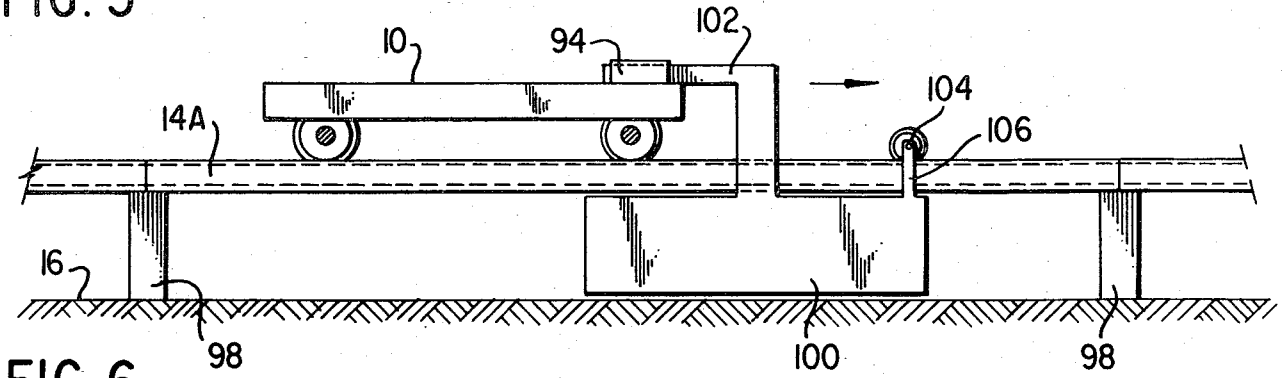
FIG. 6 is a side elevation view of an embodiment of the invention which includes a traveling skirt enabling use of the apparatus with relatively narrow forms.

As shown in FIG. 6, relatively narrow forms 14A are affixed atop blocks 98 which are spaced beneath the butted ends of forms 14A so as not to interfer with passage of the "skirts" (hereinafter described) along the insides of forms 14A. A pair of metal skirts 100 (one of which is depicted in FIG. 6) are provided with rigid arms 102 which are removably slidingly received in sleeves 94 disposed on either side of frame forward end 18. Each of skirts 100 hangs inside forms 14A to project ahead of frame forward end 18 and form a vertical wall between grade 16 and the lower surface of forms 14A. Flanged guide wheels 104 are connected by arms 106 to the forward ends of skirts 100 and positioned to travel along the tops of forms 14A to provide a means for holding skirts 100 in longitudinal alignment with forms 14A.

In operation of apparatus 10, concrete is poured from a mixing truck or other source between forms 14 directly in front of apparatus 10. Engine 30 is engaged to propel the apparatus forward and to cause concrete-tamping vibration of screed 58. Vibrator screed 58 forms and compacts the poured concrete mass to a depth which varies along transverse axes of the forms, as described above, depending upon the cross-sectional shape of vibrator screed 58. Finishing pan 82 then glides over the top surface of the formed, compacted concrete to impart a smooth finish thereto.

Operation is similar if skirts 100 and forms 14A are used. Skirts 100 comprise a "travelling form" to prevent concrete formed and compacted by vibrator screed 58 from spilling beneath forms 14A. The inventors have found that a concrete segment which has been formed and compacted by vibrator screed 58 is sufficiently rigid that side support is not required to prevent collapse of the concrete while it hardens. Hence, forms 14A serve primarily as "rails" upon which the apparatus 10 may travel—skirts 100 providing side support for the concrete in the region being formed and compacted by vibrator screed 58.

Obvious variations, modifications and departures from the specific assembly described above will readily occur to those skilled in the art without departing from the spirit of the invention as set forth in the accompanying claims. For example, engine 30 and the associated drive belts, chains and gears may be replaced with a hydraulic motor, hydraulic lines and hydraulic actuators which would simplify adaptation of the apparatus for use with forms of different widths since shaft 33 could be eliminated. In the disclosure and claims, words such as "forward" and "rearward" etc. are to be taken in a relative rather than an absolute sense, since obviously the preferred orientation of the apparatus may vary depending upon the application.

We claim:

1. Apparatus for forming, compacting and finishing the top surface of concrete poured between a pair of removable longitudinally extending parallel opposed forms, said apparatus comprising:

(a) a frame having forward and rearward ends which extend transversely between opposed first and second sides of said frame, said ends and said sides substantially defining a plane;

(b) a wooden concrete pre-finishing member disposed along the forward end of said frame, said member having a lower surface configured to vary in vertical distance from said plane along the transverse axes of the forms, and said member being relatively wide when measured in the direction of longitudinal extension of the forms;

(c) vibrator means affixed to said frame for causing vibration of said member;

(d) a finishing pan rigidly affixed beneath said frame to the rear of and adjacent said member and extending between said first and second sides of said frame and configured to vary in vertical distance from said plane along the transverse axes of the forms;

(e) transporting means on said first side of said frame and transporting means on said second side of said frame for engaging said frame on top of the forms and permitting movement of the apparatus along the forms with said ends extending transversely of the forms and with said member extending transversely between the forms; and, (f) propulsion means affixed to said frame for propelling the apparatus along the tops of forms whereby poured concrete beneath the apparatus is formed, compacted and finished to a depth which varies along transverse axes of the forms;

said member having a portion of said lower surface shaped to define a semi-conical recess in regions of relatively abrupt change in said vertical distance, the apex of said recess lying at the rearward edge of said lower surface and the base of said recess lying along the forward edge of said lower surface.

2. Apparatus as defined in claim 1, wherein said member has a width of about 8 inches when measured in the direction of longitudinal extension of the forms.

3. Apparatus as defined in claim 1 wherein said transporting means comprises first and second roller pairs respectively coupled to said first and second sides of said frame and further including extension means for adjustably fixing the vertical position of one of said roller pairs relative to said frame.

4. Apparatus as defined in claim 3 wherein said extension means comprises:

(a) a pair of cylindrically apertured sleeves rigidly affixed at opposed ends of one side of said frame and perpendicular to said plane;

(b) a pair of tubes, each of said tubes being slidingly receivable by one of said sleeves and each of said tubes including means for coupling one of said rollers to one of said tubes; and (c) means for fixing said tubes at selected positions with respect to said sleeves.

5. Apparatus as defined in claim 1 including means for selectably adjusting the spacing between said first and second sides of said frame.

6. Apparatus as defined in claim 1 wherein said forward and rearward ends of said frame comprise slidable extension members for selectably adjusting the spacing between said first and second sides of said frame.

7. Apparatus as defined in claim 1 wherein said transporting means comprises first and second roller pairs and wherein said roller pairs further comprise flanges for preventing transverse slippage of said apparatus with respect to said forms.

8. Apparatus as defined in claim 1 wherein the forms are supported above the grade on which the concrete segment is formed, further comprising a pair of skirts extending along either side of said frame to project ahead of said forward end of said frame between the lower surface of the forms and the grade, whereby poured concrete beneath said member is retained between said skirts.

9. Apparatus as defined in claim 8 further comprising means for holding said skirts in longitudinal alignment with the forms.

10. Apparatus for forming, compacting and finishing the top surface of concrete poured between a pair of removable longitudinally extending parallel opposed forms, said apparatus comprising:

(a) a frame having forward and rearward ends which extend transversely between opposed first and second sides of said frame, said ends and said sides substantially defining a plane, wherein said forward and rearward ends comprise members for selectably adjusting the spacing between said first and second sides;

(b) a wooden concrete pre-finishing member disposed along the forward end of said frame, said member having a relatively smooth lower surface configured to vary in vertical distance from said plane along the transverse axes of the forms, and said member being relatively wide when measured in the direction of longitudinal extension of the forms;

(c) vibrator means affixed to said frame for causing vibration of said member;

(d) a finishing pan rigidly affixed beneath said frame to the rear of and adjacent said member and extending between said first and second sides of said frame and configured to vary in vertical distance from said plane along the transverse axes of the forms;

(e) a first pair of rollers on said first side of said frame and a second pair of rollers on said second side of said frame for engaging said frame on top of the forms and permitting movement of the apparatus along the forms with said ends extending transversely of the forms and with said member extending transversely between the forms;

(f) extension means for adjustably fixing at least one pair of said first or second pairs of rollers at selected distances from said plane; and, (g) propulsion means affixed to said frame for propelling the apparatus along the tops of the forms whereby poured concrete beneath the apparatus is formed, compacted and finished to a depth which varies along transverse axes of the forms;

said member having a portion of said lower surface shaped to define a semi-conical recess in regions of relatively abrupt change in said vertical distance, the apex of said recess lying at the rearward edge of said lower surface and the base of said recess lying along the forward edge of said lower surface.

11. Apparatus as defined in claim 10 wherein the forms are supported above the grade on which the concrete segment is formed, further comprising a pair of skirts extending along either side of said frame to project ahead of said forward end of said frame between the lower surface of the forms and the grade, whereby poured concrete between said member is retained between said skirts.

12. Apparatus as defined in claim 11 comprising means for holding said skirts in longitudinal alignment with the forms.

13. Apparatus as defined in claim 10 wherein said extension means comprises:

(a) a pair of cylindrically apertured sleeves rigidly affixed at opposed ends of one side of said frame and perpendicular to said plane;

(b) a pair of tubes, each of said tubes being slidingly receivable by one of said sleeves and each of said tubes including means for coupling said rollers to one of said tubes; and (c) means for fixing said tubes at selected positions with respect to said sleeves.

14. Apparatus as defined in claim 10 wherein said roller pairs further comprise flanges for preventing transverse slippage of said apparatus with respect to said forms.

* * * * *